United States Patent [19]

Koller et al.

[11] 4,181,499

[45] Jan. 1, 1980

[54] PROCESS FOR THE LEVEL DYEING OF POLYACRYLONITRILE MATERIALS OF SLOW, NORMAL AND RAPID ABSORPTIVE CAPACITY

[75] Inventors: Joseph Koller, Reinach; Manfred Motter, Dornach; Peter Moser, Binnigen; Ulrich Horn, Basel, all of Switzerland; Pierre Galafassi, Rixheim, France

[73] Assignee: Ciba-Geigy Corporation, Ardsley, N.Y.

[21] Appl. No.: 829,832

[22] Filed: Sep. 1, 1977

Related U.S. Application Data

[63] Continuation of Ser. No. 625,730, Oct. 24, 1975, abandoned.

[30] Foreign Application Priority Data

Oct. 29, 1974 [CH] Switzerland ..... 14465/74

[51] Int. Cl.[2] ..... D06P 1/41; D06P 3/76; C09B 29/38; C09B 19/00

[52] U.S. Cl. ..... 8/26; 8/25; 8/169; 8/177 AB; 8/177 R; 8/82

[58] Field of Search ..... 8/169, 177 R, 177 AB, 8/25, 26

[56] References Cited

U.S. PATENT DOCUMENTS

| | | | |
|---|---|---|---|
| 2,986,444 | 5/1961 | Rokohl et al. | 8/177 AB |
| 3,574,527 | 4/1971 | Walz et al. | 8/172 |
| 3,632,300 | 1/1972 | Komninos | 8/172 |
| 3,716,329 | 2/1973 | Komninos et al. | 8/169 |
| 3,726,641 | 4/1973 | Komninos | 8/172 |
| 3,785,768 | 1/1974 | Walz et al. | 8/169 |
| 3,806,504 | 3/1974 | Mundlos et al. | 8/177 R |
| 3,945,793 | 3/1976 | Corbishley et al. | 8/173 |
| 4,052,159 | 10/1977 | Fuerst et al. | 8/169 |

FOREIGN PATENT DOCUMENTS

| | | | |
|---|---|---|---|
| 1146031 | 3/1963 | Fed. Rep. of Germany | 8/177 AB |
| 1160818 | 1/1964 | Fed. Rep. of Germany | 8/177 AB |
| 76750 | 12/1970 | Fed. Rep. of Germany | 8/177 AB |

OTHER PUBLICATIONS

Creslan Technical Info. Bulletin, TFS 0530-11, Jun. 1973.

Musterkarte BASF, 1970, pp. 62-68 and 314-329, Musterkarte BASF, 1973.

*Primary Examiner*—Donald E. Czaja
*Assistant Examiner*—Maria S. Tungol
*Attorney, Agent, or Firm*—Edward McC. Roberts

[57] ABSTRACT

Described is a process for the level dyeing of polyacrylonitrile materials, in which process there is used for dyeing polyacrylonitrile materials that have varying substantivity an aqueous dye liquor containing at least one migrating cationic dyestuff and electrolyte, as well as, optionally, at least one migrating cationic retarder and further additives. This process renders possible a level dyeing of all fibre types of polyacrylonitrile materials by one and the same dyeing method. Generally, no addition of a migrating cationic retarder is necessary. Only in the case of a light-colored dyeing is a very minor addition thereof required. Particularly suitable migrating cationic dyestuffs are those having a more or less delocalized positive charge, the cation weight of which dyestuffs is smaller than 310, the parachor smaller than 750 and the log P (relative lipophil property) smaller than 3.6.

16 Claims, No Drawings

PROCESS FOR THE LEVEL DYEING OF POLYACRYLONITRILE MATERIALS OF SLOW, NORMAL AND RAPID ABSORPTIVE CAPACITY

This is a continuation of application Ser. No. 625,730 filed on Oct. 24, 1975, now abandoned.

The invention relates to a process for the level dyeing of polyacrylonitrile materials of varying substantivity, to the liquor for carrying out this process, as well as to the polyacrylonitrile material dyed by the process.

The cationic dyestuffs specially developed for dyeing polyacrylonitrile fibres are characterised in general by very good substantivity and build-up properties, by a high level of fastness as well as by a brilliant shade of colour. On the other hand, their migration capacity on most substrates made from polyacrylonitrile fibre material, such as Orlon 42, at boiling temperature (98° to 100° C.) is only slight. The result of this is that unevenness, which occurs on account of the high rate of absorption of these dyestuffs during the absorption process, can be eliminated only under conditions that run counter to the productivity of the dyeing works or to the maintenance of quality of the textile article, e.g. conditions such as a lengthening of the boiling phase or an appreciable raising of the dyeing temperature.

There have been developed with the aim of avoiding these difficulties various dyeing processes which all have, however, the disadvantage that they have to be adapted to suit the type of polyacrylonitrile fibre, the make-up of the material, the conditions regarding apparatus, the rate of absorption of the employed dyestuffs as well as the depth of shade. The object of these processes is to extend the absorption process, either by slow heating or by the addition of considerable amounts of cationic or anionic retarders. Preference is usually given in practice to a combination of these two possibilities.

There has now been found a dyeing process which enables polyacrylonitrile materials having a varying rate of absorption, i.e. polyacrylonitrile material of rapid, slow and normal absorptive capacity, to be uniformly dyed in a simple manner. The new process is characterised in that there are used at least one migrating cationic dyestuff, at least one electrolyte, as well as, optionally, migrating cationic retarders.

With the use of migrating cationic dyestuffs, a considerable unevenness of absorption can be generally accepted since this unevenness becomes levelled out during the normal dyeing time (about 60 minutes at 98° to 100° C.). From this there accrue advantages, especially a clearly shortened heating-up phase compared with that necessary for non-migrating dyestuffs (to raise the bath temperature from 80° to 100° C., the time required is 15 to 20 minutes and no longer 45 to 90 minutes).

Furthermore, no addition of a migrating cationic for the obtainment of light shades retarder is necessary, or, for the obtainment of light shades, merely a very minute addition thereof; for example, there is required according to the invention in the case of a light-coloured dyeing about 0.1 to 0.5 percent by weight of cationic retarder of a given active-substance concentration, instead of 2 to 3 percent by weight of the same retarder with the use of non-migrating cationic dyestuffs; there results from this, apart from the ecological advantages, a saving in cost, and there arise no blocking and overdyeing problems.

The process of the invention moreover renders possible the dyeing of all fibre types of polyacrylonitrile materials by one and the same dyeing method; it is no longer necessary, as hitherto, to match the method to the type of fibres to be dyed. The advantages of this are clear: lengthy preliminary tests with unknown fibres are unnecessary, and the time and temperature regulation can be standardised; a further advantage is that dyeings which nevertheless turn out uneven can without difficulty be levelled out by extended boiling.

All the said disadvantages are overcome in the process according to the invention. The invention hence relates to a process for the level dyeing of polyacrylonitrile materials, in which process there is used for dyeing polyacrylonitrile materials that have varying substantivity an aqueous dye liquor containing at least one migrating cationic dyestuff and electrolyte, as well as, optionally, at least one migrating cationic retarder and further additives. This process renders possible a level dyeing of all polyacrylonitrile materials in all possible shades of colour.

As defined, the cationic dyestuffs and retarders usable according to the invention must possess a migration capacity.

Particularly suitable migrating cationic dyestuffs are those having a more or less delocalised positive charge, the cation weight of which dyestuffs is smaller than 310, the parachor smaller than 750 and the log P smaller than 3.6. The parachor is calculated according to the article of O. R. Quayle [Chem. Rev. 53, 439 (1953)] and log P represents the relative lipophil property, the calculation of which has been described by C. Hansch et al [J. Med. Chem. 16, 1207 (1973)]. The effect of the charge of the dyestuff cations was not taken into account, so that log P values higher by 6 log units are obtained.

Particularly suitable migrating cationic dyestuffs are those of which the cation weight is smaller than 275, the parachor smaller than 680 and the log P smaller than 2.8.

These dyestuffs can belong to various classes of dyestuffs. They are, in particular, salts, for example chlorides, sulphates, onium chlorides or metal halides, for example zinc chloride salts of azo dyestuffs, such as monoazo dyestuffs or hydrazone dyestuffs, diphenylmethane, methine or azomethine dyestuffs, ketoneimine, cyanine, azine, oxazine or thiazine dyestuffs.

Especially good results regarding the trichromic effect are obtained with the use of the yellow dyestuff of the formula I

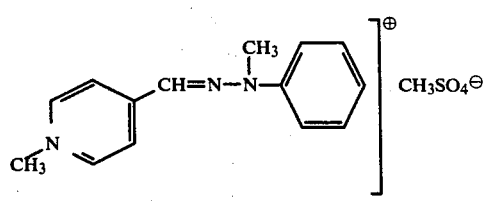

(I)

having a cation weight of 226, a parachor of 558 and a log P of 2.49; the red dyestuff of the formula II

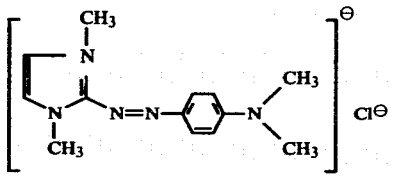

(II)

having a cation weight of 244, a parachor of 610 and a log P of 2.68; and the blue dyestuff of the formula III

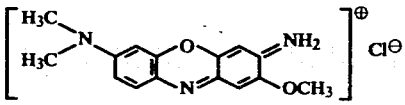

(III)

having a cation weight of 270, a parachor of 577 and a log P of 1.97.

With the combination of these three dyestuffs there becomes available for the first time a balanced trichromic effect (three-colour effect) of cationic dyestuffs having a very good migration capacity, which effect renders possible a simple and reliable dyeing process, in which in appropriate cases the addition of retarders can be dispensed with.

A migrating cationic retarder is however preferably used, in small amounts, in the case where light shades of colour are to be obtained. The retarder used must possess, just as in the case of the dyestuffs, a good migration capacity, since otherwise the well fixed retarder that has been absorbed unevenly leads to unlevel dyeings which are irreparable.

Particularly suitable retarders are those having a cation weight smaller than 310, a parachor smaller than 800 and a log P smaller than 7.0.

Among these, the retarders preferably used are those of which the cation weight is smaller than 275 and the parachor is between 650 and 750.

Such retarders usable according to the invention are e.g.: organic ammonium compounds of the general formula LVI

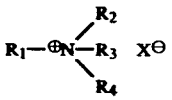

(LVI)

containing a higher alkyl radical, in which formula $R_1$ represents an unsubstituted alkyl group having 8 to 14, preferably 8 to 12 carbon atoms, $R_2$ and $R_3$ each independently represent hydrogen, a lower alkyl radical optionally substituted by hydroxyl, lower alkoxy or cyano groups, a cycloalkyl radical or a polyglycol ether chain having 2 to 4 alkyleneoxy groups, or $R_2$ and $R_3$ together with the nitrogen atom linking them represent a piperidine or morpholine ring, $R_4$ represents hydrogen, a lower alkyl radical optionally substituted by hydroxyl or lower alkoxy groups, or an aralkyl radical, and $X^{\ominus}$ represents the anion of an organic or inorganic acid.

There can also be used compounds of the general formula LVII

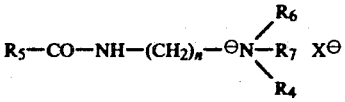

(LVII)

wherein $R_4$ represents hydrogen, an alkyl radical optionally substituted by hydroxyl groups or lower alkoxy groups, or an aralkyl radical, $R_5$ represents an unsubstituted alkyl group having 7 to 17 carbon atoms, $R_6$ and $R_7$ each represent an unsubstituted lower alkyl group, n represents 2 or 3, and $X^{\ominus}$ represents the anion of an organic or inorganic acid.

Likewise suitable are cationic organic ammonium compounds containing at least one higher alkyl radical which correspond to the formula LVIII

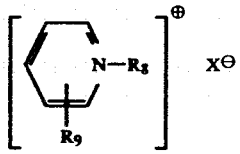

(LVIII)

wherein $R_8$ represents an alkyl chain having 8 to 18, preferably 8 to 12, carbon atoms, optionally interrupted by oxygen atoms and not further substituted, $R_9$ represents hydrogen, the methyl or ethyl group, and $X^{\ominus}$ represents the anion of an organic or inorganic acid; or compounds of the general formula LIX

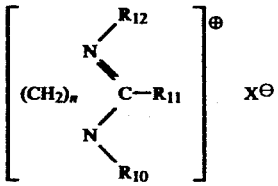

(LIX)

wherein of $R_{10}$, $R_{11}$ and $R_{12}$, one R represents an unsubstituted alkyl group having 7 to 18 carbon atoms, and the other two R's represent hydrogen, or a lower alkyl radical optionally substituted by hydroxyl groups, n represents 2 or 3, and $X^{\ominus}$ represents the anion of an organic or inorganic acid; or compounds of the general formula LX

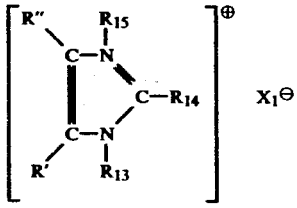

(LX)

wherein $R_{13}$ represents an unsubstituted alkyl group having 8 to 18 carbon atoms, $R_{14}$ represents hydrogen, an unsubstituted alkyl group having up to 18 carbon atoms, or the unsubstituted phenyl radical, $R_{15}$ represents an unsubstituted lower alkyl group or the benzyl radical, and $X_1\ominus$ represents the anion of hydrochloric or hydrobromic acid or of methylsulphuric acid, and R' and R'' each independently represent hydrogen, an unsubstituted alkyl group having up to 12 carbon atoms, or together with the carbon atoms linking them together they form an optionally substituted benzene ring.

Also, suitable are compounds of the general formula LXI

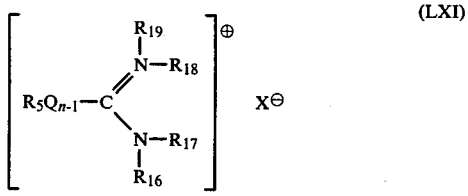

(LXI)

wherein $R_5$ represents an unsubstituted alkyl group having 7 to 17 carbon atoms, Q represents S, $NR_{20}$ or O, $R_{16}$, $R_{17}$, $R_{18}$, $R_{19}$ and $R_{20}$ each independently represent hydrogen, a lower alkyl radical optionally substituted by hydroxyl groups or lower alkoxy groups, a cycloalkyl or aralkyl group, $X\ominus$ represents the anion of an organic or inorganic acid, and n represents 1 or 2.

Particularly suitable retarders are those of the formula LXII

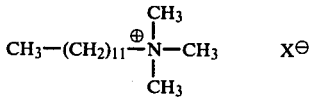

(LXII)

having a cation weight of 228, a parachor of 665 and a log P of 6.68; those of the formula LXIII

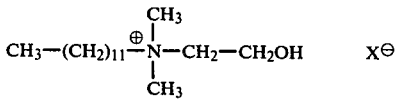

(LXIII)

having a cation weight of 258, a parachor of 744 and a log P of 5.65; as well as those of the formula LXIV

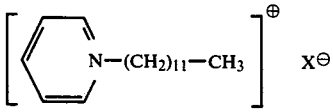

(LXIV)

having a cation weight of 248, a parachor of 693 and a log P of 6.32, wherein $X\ominus$ represents the anion of an organic or inorganic acid.

The addition of a retarder has the effect of reducing the dyeing rate of the cationic dyestuffs. The use of migrating cationic dyestuffs and retarders results in a saving of about 50 to 100% in the amount of retarder used compared with the amount used in the hitherto customary processes.

The amounts in which the dyestuffs and retarders usable according to the invention are used in dye baths can vary within wide limits depending on the desired depth of colour; in general, amounts of dyestuff of 0.01 to 5, preferably 0.01 to 2, percent by weight, as well as additions of retarder of 0.01 to 1, preferably 0.1 to 0.5, percent by weight of one or more of the stated dyestuffs and retarders, relative to the weight of the polyacrylonitrile material, have proved advantageous.

In addition, the dye liquor has to contain electrolytes such as sodium salts, for example sodium chloride, sodium sulphate and sodium nitrate; ammonium salts such as ammonium chloride and ammonium sulphate; potassium salts such as potassium chloride and potassium sulphate; and/or tetramethylammonium salts such as tetramethylammonium chloride. These electrolytes are used in amounts of 1 to 10, preferably 5 to 10, percent by weight, relative to the material to be dyed.

There can moreover be present in the dye liquor further additives customary in dyeing, such as formic acid, acetic acid and sulphuric acid, as well as compounds necessary for the stabilisation of a specific pH-value, such as sodium acetate, potassium acetate or ammonium acetate, sodium citrate, potassium citrate or ammonium citrate, sodium phosphate, potassium phosphate or ammonium phosphate.

The process of the invention, which has the great advantage that it does not have to be adapted to suit a particular type of polyacrylonitrile fibre, being applicable to all types, is performed preferably by the exhaust method. By virtue of the very good migration of the dyestuffs, a certain unevenness in the absorption of the dyestuffs is fully permissible, a factor attributable, e.g., to a greatly shortened heating-up phase. The unevenness occurring in the process must, however, be only of such a degree that it can be levelled out at the normal dyeing temperature (98°/100° C.) as well as during a normal boiling duration (45 to 60 minutes).

To carry out the process according to the invention, the polyacrylonitrile material to be dyed is introduced at a temperature of about 80° C. into the dyeing bath containing the necessary additives; the bath is heated within 15 to 30 minutes to 98° to 100° C., maintained for 45 to 60 minutes at this temperature and then cooled. It is however also possible to heat the dyeing bath within 15 to 30 minutes to a temperature of 105° C. (high temperature dyeing) and then to hold it at this temperature for 15 to 45 minutes; or to introduce the material at the boiling temperature and to dye for 30 to 60 minutes at this temperature before cooling the dyeing bath. It is however in general possible to carry out all conceivable variations with regard to dyeing processes.

As mentioned, the process of the invention can be applied to all types of fibres of polyacrylonitrile, i.e. to rapidly absorbing, normally absorbing and slowly absorbing polyacrylonitrile fibres. Rapidly absorbing polyacrylonitrile fibres are, e.g., EUROACRIL®, BESLON®, CASHMILON®, EXLAN DK®, TORAYLON FH®.

Normally absorbing polyacrylonitrile fibres are, e.g., COURTELLE®, ACRILAN 16®, LEACRYL 16®, MALON®, etc..

Slowly absorbing polyacrylonitrile fibres are, e.g., CRYLOR 20®, CRYLOR 50®, ORLON 42®, DRALON®, etc..

The polyacrylonitrile fibres consist principally of about 85% of an acrylic constituent and about 15% of a copolymer constituent.

The varying rate of absorption of the different types of polyacrylonitrile fibres is very closely connected with the respective glass transition point (GTP). The lower the glass transition point the higher is the absorption rate of a fibre and vice versa. The migration follows the same rules. It moreover increases greatly with rising temperature. At a given dyeing temperature, the dyestuffs migrate onto rapidly absorbing fibres about four times more rapidly than onto slowly absorbing fibres.

The making-up form of these polyacrylonitrile fibre materials can be extremely varied; for example, suitable forms are: loose material, combed sliver, cable, yarn as hank, cheeses, warp beam, muffs, rocket bobbins, wound packages, woven goods and knitwear and carpets.

The liquor ratio (ratio of kg of material to liters of liquor) is dependent on conditions with respect to equipment, on the substrate and on the make-up of the material, as well as on the packing density. It varies within wide limits, but is in most cases between 1:5 and 1:40.

The process according to the invention thus renders possible the production of level single-shade and, in particular, combination-shade dyeings at normal dyeing temperatures by use of selected migrating cationic dyestuffs. It constitutes a simple dyeing process which is independent of the type of polyacrylonitrile fibre to be dyed, in which process the heating-up times necessary are shorter than those required with the use of non-migrating cationic dyestuffs, with nevertheless completely level dyeings being obtained. There is required in the process either no cationic retarder or only minute amounts of a cationic retarder that is matched, with regard to absorption and migration behaviour, to the dyestuffs used according to the invention. It makes possible a simple reparing of dyeings which in spite of everything have turned out uneven, and enables, in particular, shading-off at boiling temperature to be effected. The process is specially suitable for the obtainment of light and super-light shades, whereby occurrence of overexcessive initial unlevel effects is avoided by the addition of small amounts of a suitable migrating cationic retarder.

The dyeings obtained are characterised by good fastness properties such as, in particular, fastness to light, fastness to wet processing, such as to washing, to water and to perspiration, and fastness to decating.

The cross sections of fibres dyed with migrating cationic dyestuffs by the process of the invention exhibit a perfect dye penetration, a condition which explains the absolutely even appearance of the dyeing.

The following examples illustrate the invention without its scope being limited to them. Temperatures are given in degrees Centigrade and percentages denote percentages by weight, relative to the weight of the fibre material. In the case of the dyestuffs and retarders, the symbols have the following meanings: K=cation weight, Pa=parachor and log P=relative lipophil property. The given amounts of dyestuff relate to undiluted material: the amounts of retarder relate to commercial material, i.e. diluted material.

EXAMPLE 1

25 kg of polyacrylonitrile yarn of unknown origin (hank yarn) is introduced into a Scholl circular dyeing machine containing an aqueous dye liquor (about 875 liters) consisting of 0.3% of an aqueous solution of dodecyltrimethylammonium chloride, 2% of 80% acetic acid, 1% of cryst. sodium acetate, 10% of Glauber's salt and a dyestuff mixture of 0.013% of the yellow dyestuff of the formula I (K=226, Pa=558 and log P=2.49)

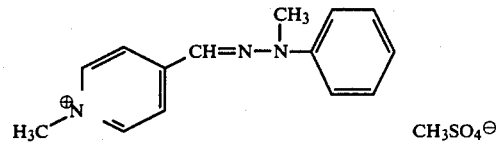

(I), 0.028% of the red dyestuff of the formula II (K=244, Pa=610 and log P=2.68)

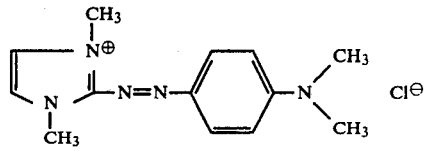

(II)

and 0.0025% of the blue dyestuff of the formula III (K=270, Pa=577 and log P=1.97)

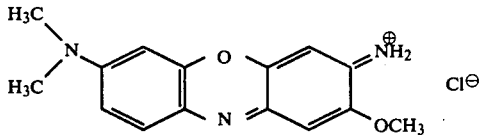

(III), in a ratio of goods to liquor of about 1:35 at 80°, and the material is shrunk for 5 minutes at this temperature. The bath is subsequently heated within about 25 minutes to 98° to 99° and the material is dyed for 60 minutes at this temperature.

The bath is then cooled, the material is centrifuged and dried. There is obtained a completely level polyacrylonitrile yarn dyed in a light-beige combination shade (trichromic effect).

If there were used, instead of the above dyestuff mixture, a mixture of non-migrating cationic dyestuffs, then in the case of a light beige dyeing of the above kind the heating-up phase of the dye bath would have to be at least doubled in length and the retarder addition increased from 0.3% to 2–3%, i.e. by about 7 to 10 times, in order to obtain an equally level dyeing.

If there are used, instead of the yellow dyestuff of the formula I, the yellow dyestuffs listed in the following Table A, with otherwise the same procedure, then similarly level combination shades are obtained.

Table A
| No. | Yellow dyestuffs | K | log P | Pa |
|---|---|---|---|---|
| IV | 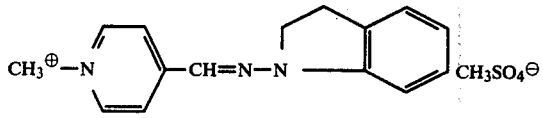 | 237 | 2,99 | 568 |
| V | 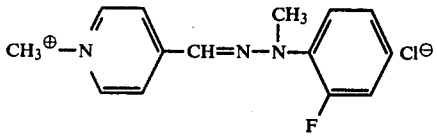 | 244 | 2,43 | 568 |
| VI | 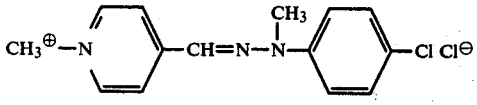 | 261 | 3,00 | 581 |
| VII | 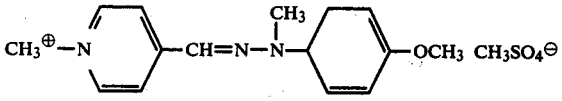 | 256 | 2,49 | 618 |
| VIII | 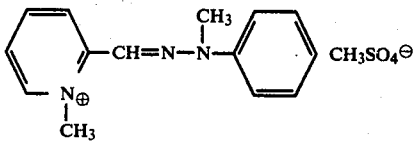 | 226 | 2,49 | 558 |
| IX | 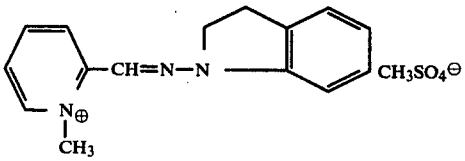 | 237 | 2,99 | 568 |
| X | 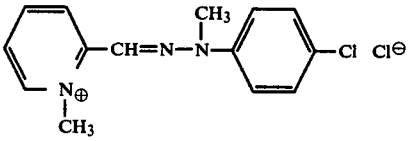 | 261 | 3,00 | 581 |
| XI | 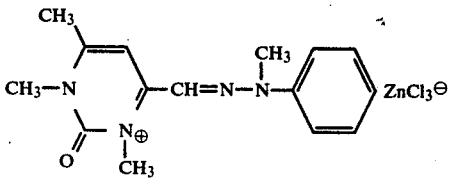 | 271 | 0,92 | 683 |
| XII | 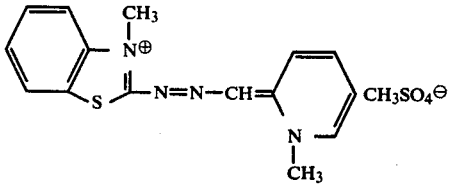 | 283 | 3,53 | 682 |
| XIII | 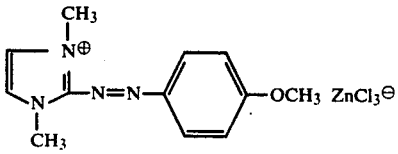 | 231 | 1,63 | 546 |

Table A-continued

| No. | Yellow dyestuffs | K | log P | Pa |
|---|---|---|---|---|
| XIV | 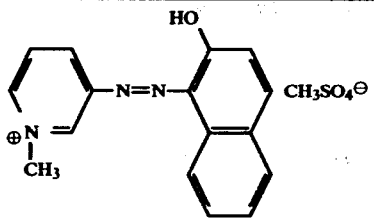 | 264 | 3,25 | 646 |
| XV | 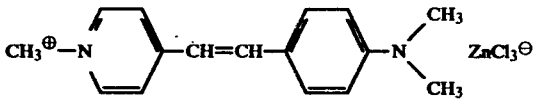 | 239 | 3,28 | 633 |

If there are used in the Examples, instead of the red dyestuff of the formula II, the red cationic dyestuffs listed in the following Table B, in combination with the yellow dyestuff of the formula I or with the yellow dyestuffs of the Table A and the blue dyestuff of the formula III, with otherwise the same procedure, then analogously good combination shades are obtained.

If there are used, instead of the blue dyestuff of the formula III, the blue cationic dyestuffs given in the following Table C in combination with the yellow dyestuff of the formula I, or with the yellow dyestuffs of the Table A, and the red dyestuff of the formula II, or with the red dyestuffs in Table B, with otherwise the same procedure as described in Example 1, then similarly level combination shades are obtained.

Table B

| No. | Red dyestuffs | K | log P | Pa |
|---|---|---|---|---|
| XVI | 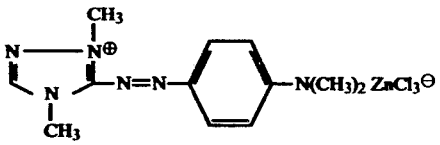 | 245 | 1,57 | 620 |
| XVII | 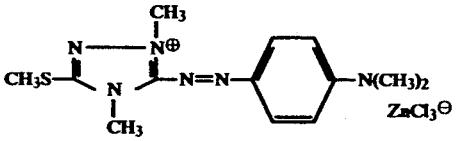 | 291 | 2,18 | 727 |
| XVIII | 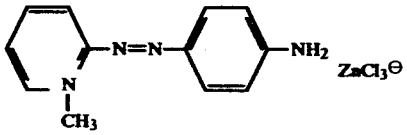 | 213 | 1,28 | 529 |
| XIX | 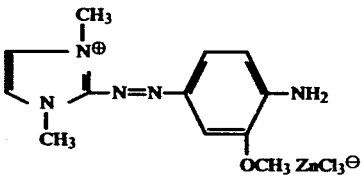 | 246 | 0,16 | 594 |
| XX | 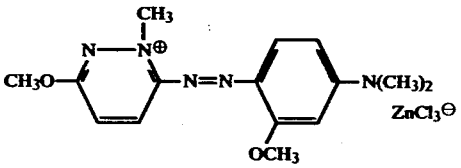 | 302 | 0,80 | 723 |
| XXa | 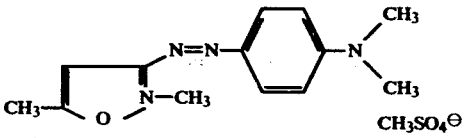 | 245 | 2,70 | 610 |

Table C
| No. | Blue dyestuffs | K | log P | Pa |
|---|---|---|---|---|
| XXI | 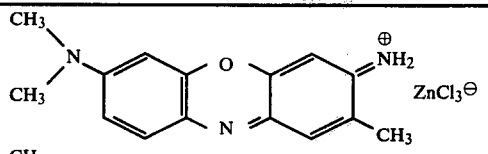 | 254 | 1,87 | 577 |
| XXII | 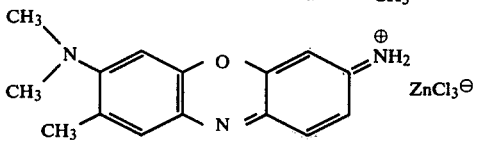 | 254 | 1,87 | 577 |
| XXIII | 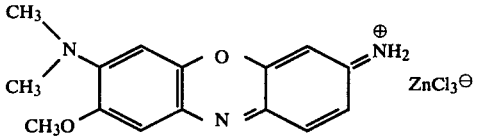 | 270 | 1,37 | 580 |
| XXIV | 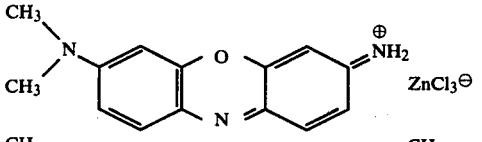 | 240 | 1,37 | 522 |
| XXV | 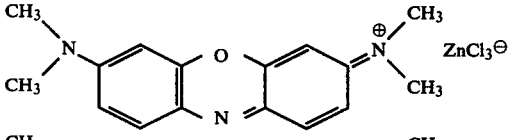 | 268 | 2,78 | 596 |
| XXVI | 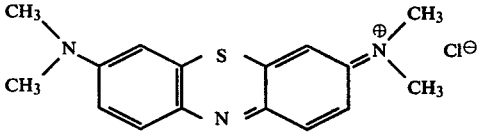 | 284 | 3,08 | 638 |
| XXVII | 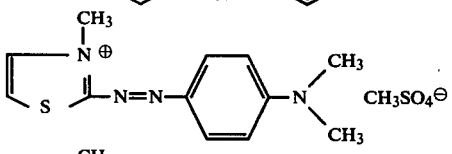 | 247 | 2,27 | 565 |
| XXVIII | 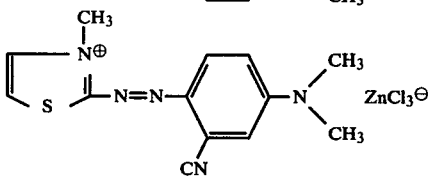 | 272 | 1,70 | 622 |
| XXIX | 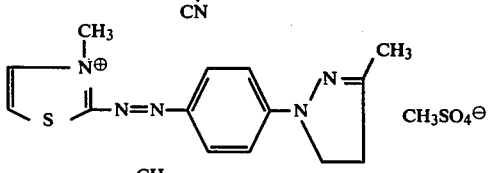 | 286 | 1,29 | 647 |
| XXX | 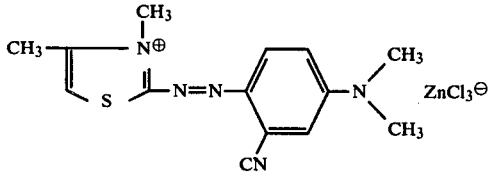 | 286 | 2,20 | 687 |
| XXXI | 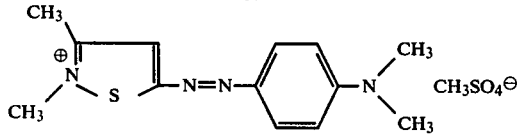 | 261 | 1,87 | 620 |
If there are used, instead of the yellow and red dyestuffs, orange-coloured and scarlet cationic dyestuffs, respectively, according to the following Table D, with otherwise the same procedure as described in Example 1, then there are obtained by the combination with the aforementioned dyestuffs likewise very level combination shades.
Table D
| No. | Orange dyestuffs | K | log P | Pa |
|---|---|---|---|---|
| XXXII | 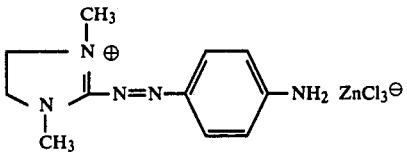 | 216 | 0,16 | 535 |
| XXXIII | 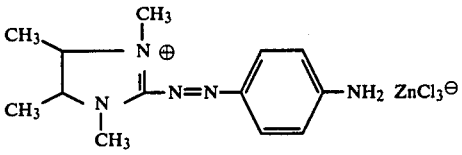 | 244 | 1,16 | 645 |
| XXXIV | 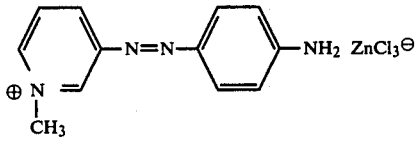 | 213 | 1,28 | 529 |
| XXXV | 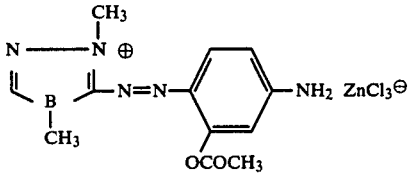 | 275 | 0,66 | 741 |
| XXXVI | 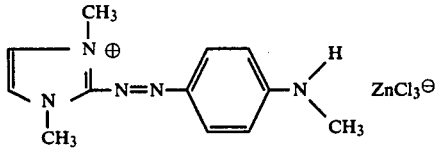 | 230 | 0,92 | 574 |
| XXXVII | 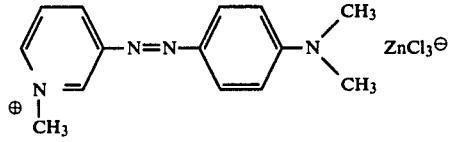 | 241 | 2,69 | 605 |
| XXXVIII | 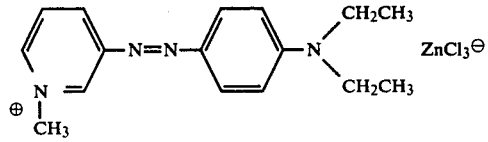 | 269 | 3,42 | 685 |
| XXXIX | 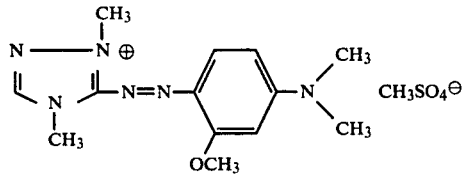 | 275 | 1,30 | 679 |
| XL | 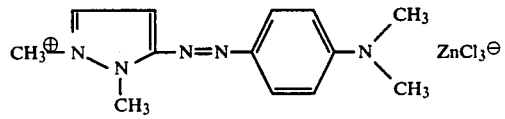 | 244 | 1,57 | 610 |

Table D-continued

| No. | Orange dyestuffs | K | log P | Pa |
|---|---|---|---|---|
| XLI | 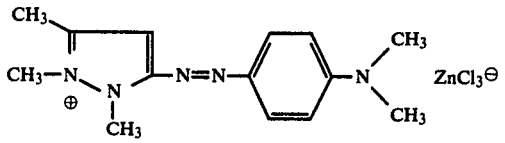 | 258 | 2,07 | 665 |

If there are used, instead of the blue or red dyestuffs, violet cationic dyestuffs according to the following Table E, with otherwise the same procedure, then there are obtained by the combination with the aforementioned dyestuffs likewise very level combination shades.

Table E

| No. | Violet dyestuffs | K | log P | Pa |
|---|---|---|---|---|
| XLII | 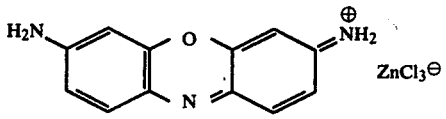 | 212 | −0,04 | 446 |
| XLIII | 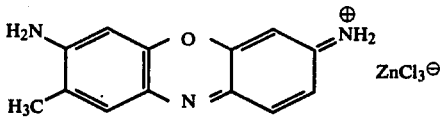 | 226 | 0,46 | 501 |
| XLIV | 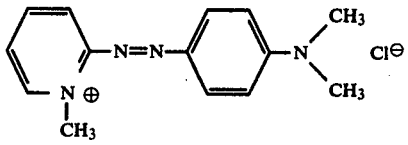 | 241 | 2,69 | 605 |
| XLV | 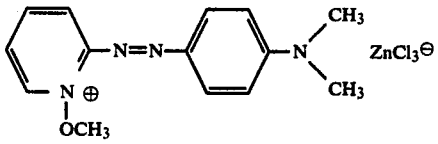 | 257 | 3,42 | 609 |
| XLVI | 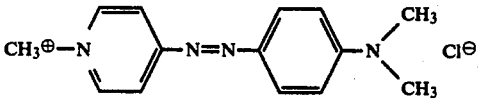 | 241 | 2,69 | 605 |
| XLVII | 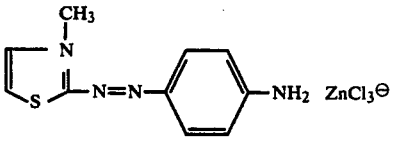 | 219 | 0,59 | 490 |
| XLVIII | 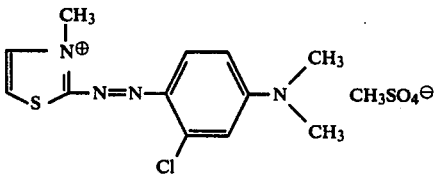 | 282 | 2,71 | 603 |
| IL | 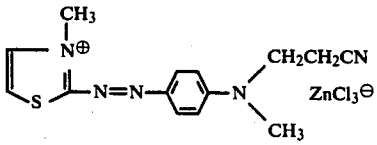 | 286 | 1,79 | 677 |

Table E-continued

| No. | Violet dyestuffs | K | log P | Pa |
|---|---|---|---|---|
| L | 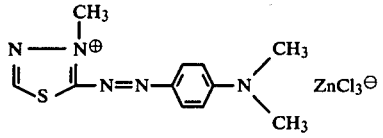 | 248 | 2,10 | 565 |
| LI | 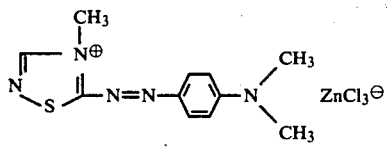 | 248 | 1,37 | 575 |
| LII | 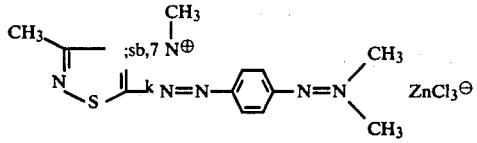 | 262 | 1,60 | 630 |
| LIII | 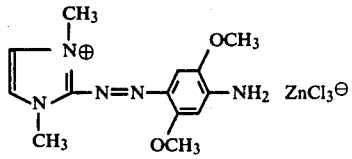 | 276 | 0,16 | 653 |
| LIV | 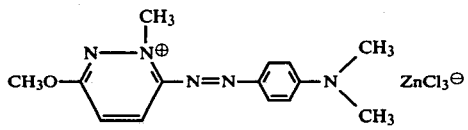 | 272 | 0,80 | 670 |

EXAMPLE 2

121 kg of Dralon high-bulk yarn (slowly absorbing FAC) in the form of hank yarn is placed into a Scholl circular dyeing machine containing an aqueous dye liquor (about 4200 liters) made up of 0.5% of an aqueous solution of dodecyltrimethylammonium chloride, 2% of 80% acetic acid, 1% of cryst. sodium acetate, 10% of calcined Glauber's salt and a dyestuff mixture of 0.015% of the dyestuff of the formula I, 0.04% of the dyestuff of the formula II and 0.01% of the dyestuff of the formula III according to Example 1, with a ratio of goods to liquor of about 1:35 at 80°, and the material is shrunk for 5 minutes at this temperature. The temperature is subsequently raised in the course of about 25 minutes to 98° to 99° and dyeing is performed for 60 minutes at this temperature. The bath is then cooled and the material is centrifuged and dried.

There is obtained a completely evenly dyed light-grey Dralon yarn.

EXAMPLE 3

25 kg of polyacrylonitrile yarn of unknown origin (hank yarn) is fed into a Scholl circular dyeing machine containing an aqueous dye liquor (about 875 liters) made up of 2% of 80% acetic acid, 1% of crystallised sodium acetate, 10% of calcined Glauber's salt and a dyestuff mixture consisting of 0.5% of the dyestuff of the formula I and 0.23% of the dyestuff of the formula III according to Example 1, with a ratio of goods to liquor of about 1:35 at 80°, and the material is shrunk for 5 minutes at this temperature. The temperature is subsequently raised within about 25 minutes to 98° to 99° and dyeing is performed for 60 minutes at this temperature. The bath is then cooled and the material is centrifuged and dried.

There is obtained a completely evenly dyed medium green polyacrylonitrile yarn.

EXAMPLE 4

243 kg of Dralon high-bulk yarn 40/1 (slowly absorbing PAC) in the form of hank yarn is fed into a Scholl circular dyeing machine containing an aqueous dye liquor (about 8500 liters) made up of 2% of 80% acetic acid, 1% of crystallised sodium acetate, 10% of calcined Glauber's salt and a dyestuff mixture consisting of 0.08% of the dyestuff of the formula I, 0.9% of the dyestuff of the formula II and 1.0% of the dyestuff of the formula III according to Example 1, with a ratio of goods to liquor of about 1:35, at 80°, and the material is shrunk for 5 minutes at this temperature. The temperature is subsequently raised within about 25 minutes to 98° to 99° and dyeing is performed for 60 minutes at this temperature. The bath is then cooled and the material is centrifuged and dried.

There is obtained a completely evenly dyed navy blue Dralon yarn.

EXAMPLE 5

100 kg of Beslon high-bulk yarn 40/2 (rapidly absorbing PAC) in the form of hank yarn is fed into an Ochsner dyeing machine containing an aqueous dye liquor (about 4000 liters) made up of 2% of 80% acetic acid, 1% of crystallised sodium acetate, 10% of calcined Glauber's salt and a dyestuff mixture consisting of 1.1% of the dyestuff of the formula I, 0.07% of the dyestuff of the formula II and 0.36% of the dyestuff of the formula III according to Example 1, with a ratio of goods to liquor of 1:40, at 78°. The temperature is raised within 30 minutes to 98° to 99° and dyeing is performed for 60 minutes at this temperature. The bath is then cooled and the material is centrifuged and dried.

There is obtained a completely evenly dyed green Beslon yarn.

If non-migrating dyestuffs are used, then about a two to three times longer heating time and 0.5 to 1% of a cationic retarder are required to obtain a level dyeing.

EXAMPLE 6

24 kg of Orlon TD high-bulk yarn 44/2 (slowly absorbing PAC; wound packages each 900 g in weight) is fed into a dyeing machine (Vald. Hendriksen GRU 15 HT) containing an aqueous dye bath at 80° (about 410 liters) made up of 0.25% of an aqueous solution of dodecyloxethyldimethylammonium chloride, 2% of 60% acetic acid, 1% of crystallised sodium acetate, 10% of calcined Glauber's salt and a dyestuff mixture of 0.05% of the dyestuff of the formula I, 0.15% of the dyestuff of the formula II and 0.03% of the dyestuff of the formula III according to Example 1, with a ratio of goods to liquor of 1:17. The bath is heated within 20 minutes to 98° to 99° and dyeing is performed at the boiling temperature for 60 minutes. The bath is then allowed to cool, the material is centrifuged and dried.

There is obtained an evenly dyed light-grey yarn. 6 kg of the light-grey dyed yarn is subsequently shaded as follows: the material is treated firstly for 15 minutes at 100° in an aqueous bath containing 2% of 60% acetic acid, 1% of crystallised sodium acetate and 10% of calcined Glauber's salt. There is then added to the dye bath, by way of the supplementary vessel, in the course of 1 to 2 minutes the aqueous shading additive containing 0.5% of an aqueous solution of dodecyltrimethylammonium chloride and 0.015% of the dyestuff of the formula III, and dyeing is performed for 30 minutes at 100°.

There is obtained a shaded yarn having excellent levelness.

EXAMPLE 7

12 kg of Orlon TD high-bulk yarn 44/2 (slowly absorbing PAC) in the form of hank yarn is fed into a dyeing machine (Vald. Hendriksen GRU 15 HT) containing an aqueous dye bath at 80° (about 420 litres) made up of 0.25% of a solution of dodecyltrimethylammonium chloride, 2% of 60% acetic acid, 1% of crystallised sodium acetate, 10% of calcined Glauber's salt and a dyestuff mixture of 0.05% of the dyestuff of the formula I, 0.15% of the dyestuff of the formula II and 0.03% of the dyestuff of the formula III according to Example 1, with a ratio of goods to liquor of 1:35. The bath is subsequently heated to 98° to 99° in 20 minutes and dyeing is performed for 60 minutes at boiling temperature. The bath is then allowed to cool and the material is centrifuged and dried.

There is obtained a completely evenly dyed light-grey yarn.

EXAMPLE 8

12 kg of Cashmilon high-bulk yarn (rapidly absorbing PAC) 40/2 in the form of hank yarn is fed into a dyeing machine (Vald. Hendriksen GRU 15 HT) containing an aqueous dye bath at 80° (about 420 litres) made up of 0.2% of a solution of dodecyloxethyldimethylammonium chloride, 2% of 60% acetic acid, 1% of crystallised sodium acetate, 10% of calcined Glauber's salt and a dyestuff mixture of 0.05% of the dyestuff of the formula I, 0.15% of the dyestuff of the formula II and 0.03% of the dyestuff of the formula III according to Example 1, with a ratio of goods to liquor of about 1:35. The temperature is subsequently raised within 20 minutes to 98° to 99° and the material is dyed for 60 minutes at the boiling temperature. The bath is then allowed to cool and the material is centrifuged and dried.

There is obtained a completely evenly dyed light-grey yarn.

EXAMPLE 9

4 g of Vonnel 17-staple fabric (rapidly absorbing PAC) is placed into an AHIBA laboratory dyeing apparatus having dye beakers of stainless steel containing an aqueous dye liquor at 95° made up of 2% of 80% acetic acid, 5% of calcined Glauber's salt, 0.245% of the dyestuff of the formula I and 0.11% of the dyestuff of the formula II; the dye bath is subsequently heated within 5 minutes to boiling, and dyeing is performed for 60 minutes at 98° to 100° (ratio of goods to liquor 1:40). The bath is allowed to cool and the material is rinsed.

There is obtained in this manner an absolutely evenly dyed orange fabric.

This dyed fabric is treated together with the same amount of an undyed identical fabric for 60 minutes at the boiling temperature in a fresh bath containing 2% of 80% acetic acid and 10% of calcined Glauber's salt, as a result of which there is obtained between the dyed and undyed fabric a good equalisation, which is not obtained with the use of non-migrating cationic dyestuffs.

EXAMPLE 10

4 g of Acrilan 16-staple fabric (normally absorbing PAC) is fed into an AHIBA laboratory dyeing apparatus containing an aqueous dye liquor at 80° made up of 2% of 80% acetic acid, 10% of calcined Glauber's salt and 0.25% of the dyestuff of the formula I according to Example 1; and the dye bath is subsequently heated within 30 minutes to a temperature of 98° to 100° and dyeing is performed for 60 minutes at this temperature (ratio of goods to liquor about 1:40). The dye bath is allowed to cool and the perfectly dyed plain-yellow fabric is then rinsed.

If the above procedure is carried out analogously except that there is added to the bath, instead of 0.25% of the dyestuff of the formula I, 0.33% of the dyestuff of the formula II or 0.25% of the dyestuff of the formula III according to Example 1, then in the former case there is obtained a plain red fabric and in the latter case a plain blue fabric.

The three yellow, red and blue dyed fabrics, which under the microscope show an excellent dye penetration through the fibre cross-section, are together levelled in a treatment bath containing 2% of 80% acetic acid and 10% of calcined Glauber's salt for 60 minutes at 105° with a ratio of goods to liquor of about 1:40. The three original plain dyeings display after levelling a uniform brown combination shade.

If the above procedure is carried out in an analogous manner except that non-migrating dyestuffs are used, then only a very slight exchange of colours occurs.

EXAMPLE 11

51 kg of Leacril 16 regular yarn 26/2 (normally absorbing PAC) (cheeses) is fed into a cheese dyeing machine (Vald. Hendriksen GRU 35 HT) containing an aqueous dye bath (about 1000 litres) at 80° made up of 0.5% of an aqueous solution of dodecyltrimethylammonium chloride, 2% of 80% acetic acid, 1% of crystallised sodium acetate, 10% of calcined Glauber's salt and a dyestuff mixture of 0.035% of the dyestuff of the formula I, 0.057% of the dyestuff of the formula II and 0.063% of the dyestuff of the formula III according to Example 1, with a ratio of goods to liquor of 1:20. The machine is closed, the dye liquor is heated within 30 minutes to 105°, and dyeing is performed for 30 minutes at this temperature. The bath is then allowed to cool and the material is centrifuged and dried.

There is obtained a completely level light-beige dyeing.

EXAMPLE 12

4 g of Crylor 50 staple fabric (slowly absorbing PAC fibre) is fed into an AHIBA laboratory dyeing apparatus having dye beakers of stainless steel containing an aqueous dye liquor at about 80° made up of 2% of 80% acetic acid, 10% of calcined Glauber's salt, 0.15% of the yellow dyestuff of the formula VIII and 0.35% of the red dyestuff of the formula II, and the dye bath is subsequently heated within 30 minutes to boiling and dyeing is performed for 60 minutes at 98° to 100° (ratio of goods to liquor 1:40). The bath is allowed to cool and the material is rinsed.

There is obtained a completely evenly dyed scarlet fabric.

EXAMPLE 13

4 g of Acrilan 16 high-bulk yarn (normally absorbing PAC fibre) is fed into an AHIBA laboratory dyeing apparatus provided with dye beakers of stainless steel containing an aqueous liquor at about 80° made up of 0.25% of an aqueous solution of dodecyloxethyldimethylammonium chloride, 2% of 80% acetic acid, 10% of sodium chloride, 0.17% of the yellow dyestuff of the formula X and 0.08% of the blue dyestuff of the formula III, and the dye bath is then heated within 20 minutes to boiling, and dyeing is performed for 60 minutes at 98° to 100° (ratio of goods to liquor 1:40). The dye bath is allowed to cool and the material is rinsed. There is obtained an evenly dyed light-green yarn.

EXAMPLE 14

4 g of Euroacryl staple fabric (rapidly absorbing PAC fibre) is fed into an AHIBA laboratory dyeing apparatus having dye beakers of stainless steel containing an aqueous dye liquor at about 80° made up of 2% of 80% acetic acid, 1% of cryst. sodium acetate, 10% of Glauber's salt (calcined), 0.35% of the red dyestuff of the formula XVI and 0.15% of the blue dyestuff of the formula III, and the dyestuff is heated within 30 minutes to boiling. Dyeing is then performed for 60 minutes at 98° to 100° (ratio of goods to liquor 1:40). The bath is allowed to cool and the material is rinsed. There is obtained an absolutely evenly dyed reddish-violet fabric.

EXAMPLE 15

4 g of Leacril 16 regular yarn 26/2 (normally absorbing PAC) is fed into an AHIBA laboratory apparatus having dye beakers of stainless steel containing an aqueous liquor at about 80° made up of 0.3% of an aqueous solution of dodecyltrimethylammonium chloride, 2% of 80% acetic acid, 5% of calcined Glauber's salt and the dyestuff mixture of 0.01% of the orange dyestuff of the formula XXXII, 0.03% of the scarlet red dyestuff of the formula XIX and 0.0025% of the blue dyestuff of the formula XXIX, and the dye bath is subsequently heated within 30 minutes to boiling. Dyeing is performed for 60 minutes at 98° to 100° (ratio of goods to liquor 1:40). The bath is allowed to cool and the material is rinsed. There is obtained an evenly dyed fabric in a light-brown shade.

EXAMPLE 16

4 g of Orlon 42 staple fabric (slowly absorbing PAC material) is fed into an AHIBA laboratory dyeing apparatus having dye beakers of stainless steel containing an aqueous dye liquor at about 80° made up of 0.45% of an aqueous solution of dodecyloxethyldimethylammonium chloride, 2% of 80% acetic acid, 1% of crystallised sodium acetate, 10% calcined Glauber's salt and 0.025% of the blue dyestuff of the formula III; and the dye bath is subsequently heated within 30 minutes to boiling. Dyeing is performed for 60 minutes at 98° to 100° (ratio of goods to liquor 1:40). The bath is allowed to cool and the material is rinsed. There is obtained an evenly dyed greenish-blue fabric.

The same material dyed under identical dyeing conditions with 0.025% of the non-migrating blue dyestuff of the formula

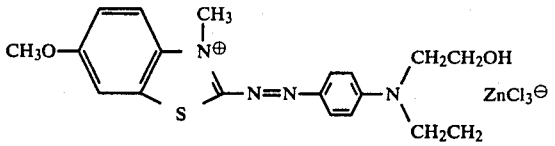

produces a light-blue dyeing which, with regard to levelness, fails absolutely to satisfy the requirements in practice. To obtain a satisfactory dyeing with the last-mentioned dyestuff it would be necessary under identical conditions to use 5 to 10 times the amount of retarder.

EXAMPLE 17

4 g of Courtelle staple fabric (normally absorbing PAC fibre) is fed into an HT laboratory dyeing apparatus containing an aqueous dye liquor at about 80° made up of 2% of acetic acid, 10% of ammonium sulphate and 0.45% of the violet dyestuff of the formula XLIV and 0.05% of the blue dyestuff of the formula XXXI. The apparatus is closed and the dye bath is then heated within 30 minutes to 105°, and dyeing is performed for 45 minutes at this temperature (ratio of goods to liquor 1:30). The bath is allowed to cool and the material is rinsed. There is obtained an evenly dyed bluish-violet fabric.

EXAMPLE 18

4 g of Exlan DK high-bulk yarn (rapidly absorbing PAC fibre) is fed into an AHIBA laboratory dyeing apparatus having dye beakers of stainless steel containing an aqueous dye liquor at about 80° made up of 2% of 80% acetic acid, 1% of crystallised sodium acetate, 10% of calcined Glauber's salt and the dyestuff mixture of 0.35% of the gold-yellow dyestuff of the formula XII, 0.12% of the red dyestuff of the formula XVIII and 0.05% of the blue dyestuff of the formula III; and the dye bath is subsequently heated within 30 minutes to boiling. Dyeing is performed for 45 minutes at 98° to 100° (ratio of goods to liquor 1:40). The bath is allowed to cool and the material is rinsed. There is obtained an absolutely evenly dyed light-brown yarn.

EXAMPLE 19

4 g of Acrilan 16 high-bulk yarn (normally absorbing PAC fibre) is fed into an AHIBA laboratory dyeing apparatus having dye beakers of stainless steel containing an aqueous dye liquor at about 80° made up of 2% of 80% acetic acid, 10% of calcined Glauber's salt and a dyestuff mixture of 0.475% of the yellow dyestuff of the formula I and 0.025% of the scarlet red dyestuff of the formula XL; and the dye bath is then heated within 30 minutes to boiling, and dyeing is performed for 60 minutes at 98° to 100° (ratio of goods to liquor 1:40). The bath is allowed to cool, and the material is rinsed. There is obtained an absolutely evenly fully dyed gold-yellow yarn.

EXAMPLE 20

4 g of Orlon 42 staple fabric (slowly absorbing PAC material) is fed into an AHIBA laboratory dyeing apparatus having dye beakers of stainless steel containing an aqueous dye liquor at 80° made up of 0.45% of an aqueous solution of dodecylpyridinium chloride, 2% of 80% acetic acid, 1% of crystallised sodium acetate, 10% of calcined Glauber's salt and the dyestuff mixture of 0.035% of the dyestuff of the formula I, 0.057% of the dyestuff of the formula II and 0.063% of the dyestuff of the formula III according to Example 1, with a ratio of goods to liquor of 1:40; and the dye bath is subsequently heated within 30 minutes to boiling; dyeing is then performed for 60 minutes at 98° to 100°. The bath is allowed to cool and the material is rinsed.

There is obtained a completely evenly dyed light-beige fabric.

We claim:

1. A process for the level trichromic dyeing of polyacrylonitrile material selected from polyacrylonitrile materials of slow, normal and rapid absorptive capacities, comprising the step of applying to the polyacrylonitrile material an aqueous dye liquor containing (a) at least one each of a red, a blue and a yellow migrating cationic dyestuff which has a cation weight of less than 310, a parachor of less than 750 and log P of less than 3.6; and (b) 1 to 10% by weight, relative to the weight of the polyacrylonitrile material, of an inorganic electrolyte.

2. The process of claim 1, wherein the aqueous dye liquor further contains a migrating cationic retarder which has a cation weight of less than 310, a parachor of less than 800 and a log P of less than 7.0.

3. The process of claim 1, wherein the migrating cationic dyestuff has a cation weight of less than 275, a parachor of less than 680, and a log P less than 2.8.

4. The process of claim 1, wherein the yellow dyestuff is of the formula

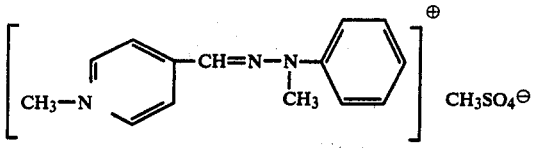

5. The process of claim 1, wherein the blue dyestuff is of the formula

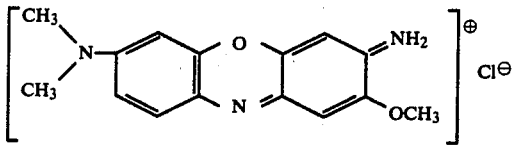

6. The process of claim 1, wherein the red dyestuff is of the formula

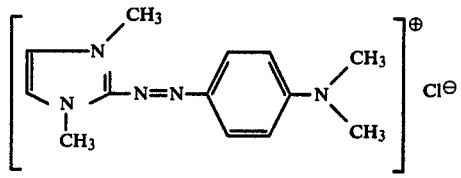

7. The process of claim 2, wherein the migrating cationic retarder has a cation weight of less than 275 and a parachor between 650 and 750.

8. The process of claim 2, wherein the migrating cationic retarder is of the formula

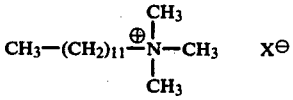

wherein $X^{\ominus}$ represents the anion of an organic or inorganic acid.

9. The process of claim 2, wherein the migrating cationic retarder is of the formula

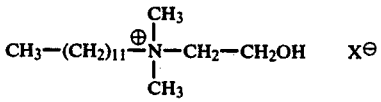

wherein $X^{\ominus}$ represents the anion of an organic or inorganic acid.

10. The process of claim 2, wherein the migrating cationic retarder is of the formula

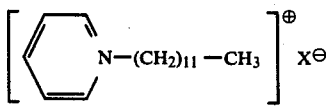

wherein $X^{\ominus}$ represents the anion of an organic or inorganic acid.

11. The process of claim 1, wherein the dye liquor contains 0.01 to 5 percent by weight of the migrating cationic dyestuffs, relative to the weight of the polyacrylonitrile material.

12. The process of claim 2, wherein the dye liquor contains 0.01 to 1 percent by weight of the migrating cationic retarder, based on the weight of the polyacrylonitrile material.

13. The process of claim 1, wherein the dyeing is carried out by the exhaust process.

14. The process of claim 1 wherein the aqueous dye liquor is applied to the polyacrylonitrile material at a temperature of about 80° C., and the dyeing temperature is achieved in 15 to 30 minutes and is held for 45 to 60 minutes.

15. The process of claim 1, wherein the aqueous dye liquor is applied to the polyacrylonitrile material at a temperature of about 80°, and the dyeing temperature of 105° C. is achieved in 15 to 30 minutes and held 15 to 45 minutes.

16. A process for the level trichromic dyeing of polyacrylonitrile material selected from polyacrylonitrile materials of slow, normal and rapid absorptive capacities, comprising the steps of introducing the polyacrylonitrile material into an aqueous dye liquor containing (a) at least one each of a red, a blue and a yellow migrating, cationic dyestuff which has a cation weight of less than 310, a parachor of less than 750 and log P of less than 3.6; and (b) 1 to 10% by weight, relative to the weight of the polyacrylonitrile material, of an inorganic electrolyte, at a temperature of 95° to 100° C., and maintaining the liquor at this temperature for 30 to 60 minutes.

* * * * *